US006534471B1

(12) United States Patent
Block et al.

(10) Patent No.: US 6,534,471 B1
(45) Date of Patent: Mar. 18, 2003

(54) METHOD FOR PRODUCING COLORED DETERGENTS AND CLEANING AGENTS

(75) Inventors: Christian Block, Cologne (DE); Antoni Machin, Barcelona (ES); Hans-Friedrich Kruse, Korschenbroich (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/600,341

(22) PCT Filed: Jan. 7, 1999

(86) PCT No.: PCT/EP99/00040

§ 371 (c)(1),
(2), (4) Date: Dec. 4, 2000

(87) PCT Pub. No.: WO99/36498

PCT Pub. Date: Jul. 22, 1999

(30) Foreign Application Priority Data

Jan. 15, 1998 (DE) ..... 198 01 186

(51) Int. Cl.[7] ..... C11D 11/00; C11D 11/02; C11D 3/40

(52) U.S. Cl. ..... 510/438; 510/376; 510/443; 510/452

(58) Field of Search ..... 510/438, 376, 510/443, 452

(56) References Cited

U.S. PATENT DOCUMENTS

| | | | | |
|---|---|---|---|---|
| 3,519,054 A | | 7/1970 | Cavataio et al. | 159/48 |
| 3,850,833 A | * | 11/1974 | Koceich et al. | 510/368 |
| 4,162,228 A | * | 7/1979 | Robles | 510/438 |
| 4,196,103 A | | 4/1980 | Richter | |
| 4,406,808 A | * | 9/1983 | Gangwisch et al. | 510/323 |
| 4,434,068 A | * | 2/1984 | Delwel et al. | 510/442 |
| 4,457,858 A | * | 7/1984 | Saran et al. | 510/376 |
| 4,664,839 A | | 5/1987 | Rieck | |
| 4,770,666 A | * | 9/1988 | Clauss | 8/111 |
| 4,816,553 A | | 3/1989 | Baur et al. | |
| 4,820,439 A | | 4/1989 | Rieck | |
| 4,997,590 A | * | 3/1991 | Bowling | 252/186.31 |
| 5,318,733 A | | 6/1994 | Carduck et al. | |
| 5,382,377 A | | 1/1995 | Raehse et al. | |
| 5,501,814 A | | 3/1996 | Engelskirchen et al. | |
| 5,516,447 A | | 5/1996 | Bauer et al. | |
| 5,541,316 A | | 7/1996 | Engelskirchen et al. | 510/471 |
| 5,580,941 A | | 12/1996 | Krause et al. | 527/300 |
| 5,616,550 A | | 4/1997 | Kruse et al. | 510/444 |
| 5,830,956 A | | 11/1998 | Stockhausen et al. | 526/318.2 |

FOREIGN PATENT DOCUMENTS

| | | |
|---|---|---|
| DE | 42 21 381 | 2/1994 |
| DE | 43 00 772 | 7/1994 |
| DE | 195 42 830 | 5/1997 |
| EP | 0 138 410 | 4/1985 |
| EP | 0 164 514 | 12/1985 |
| EP | 0 280 223 | 8/1988 |
| EP | 0 339 996 | 11/1989 |
| EP | 0 420 317 | 4/1991 |
| EP | 0 525 239 | 2/1993 |
| EP | 0 486 592 | 6/1994 |
| GB | 2 199 338 | 7/1988 |
| JP | 58-217598 | 12/1983 |
| WO | WO 90/13533 | 11/1990 |
| WO | WO 93/04162 | 3/1993 |
| WO | WO 93/08251 | 4/1993 |
| WO | WO 93/16110 | 8/1993 |
| WO | WO 93/23523 | 11/1993 |
| WO | WO 97/33965 | 9/1997 |

OTHER PUBLICATIONS

Guideline RAL–RG 992 "Gutesicherung sachgemabe Waschepflege", 1998.

* cited by examiner

*Primary Examiner*—Lorna M. Douyon
(74) *Attorney, Agent, or Firm*—Stephen D. Harper; Glenn E. J. Murphy

(57) ABSTRACT

A process for the production of colored detergent particles. The process is characterized in that a slurry comprising at least one powdering agent and at least one dye is spray dried so that a colored powdering agent is formed. The thus formed colored powdering agent is then applied to detergent particles.

10 Claims, No Drawings

METHOD FOR PRODUCING COLORED DETERGENTS AND CLEANING AGENTS

This invention relates to a process for the production of colored detergent particles.

Heavy-duty detergents sometimes contain dyes in the form of specks. Colors commonly used are green and blue. The function of the dyes is, for example, to compensate for the yellowing of washed fabrics or to color the particles and hence to make the detergents more attractive to the consumer.

European patent application EP 0 138 410 describes a process for the production of colored washing powder in which a particulate dye is intensively mixed with a washing powder, for example in a feed screw, so that a colored washing powder is obtained. The dyes used are ultramarine blue, Duasyn Acid Blau and Polar Brillant Blau.

U.S. Pat. No. 3,519,054 describes a process for the production of multicolored particulate products in which two liquid streams are dried in countercurrent in the form of droplets and a dye is added to one or both liquid streams, the droplets being converted into dried multicolored particles. Ultramarine blue, for example, is used as the dye. Other examples mentioned include phthalocyanine blue, indigo, rhodamine pigment, azo ruby, chrome orange, alizarin, Indanthren® Gelb, phthalocyanine green, wool violet or anthraquinone violet.

In addition, powder-form detergents containing colored, generally green or blue, specks in the powder are known from the prior art. The colored particles are often colored detergent additives such as, for example, bleach activator particles.

DE-A-195 42 320 describes colored particles for incorporation in detergents containing surfactants, builders and/or bleaching agents and a dye which can be completely or partly destroyed by oxidation in the washing process. These colored particles are produced by a process in which the individual components and the dye are made into a slurry in water and then subjected to spray drying. In this process, however, the detergents are made up in the presence of dye solutions. As a result, the production units are heavily soiled by dyes and have to be cleaned at considerable expense.

Accordingly, the problem addressed by the present invention was to provide a process for the production of colored detergent particles for incorporation in detergents which would not have any of the disadvantages of the prior art.

Accordingly, the present invention relates to a process for the production of colored detergent particles containing surfactants, builders and/or bleaching agents and a dye, characterized in that (A) the powdering agent and the dye are made into a slurry and subjected to spray drying and (B) the colored and spray-dried powdering agent is then applied to detergent particles, process steps (A) and (B) being carried out in separate steps.

The process according to the invention is preferably carried out as a spray drying process in step (A). To this end, the powdering agent and dye are first made into a slurry. The slurry thus formed is then spray dried in a spray drying tower by introducing hot air from below. Depending on the consistency of the slurry, nuclei may also be added to accelerate particle formation. The most suitable procedure is familiar to the expert. Particularly uniformly colored homogeneous powdering agent particles can be obtained by this process step and may then be used for coloring detergents.

However, instead of the spray drying process, the powdering agent particles may also be colored by spraying the dye solution onto the powdering agent particles in known manner. In this case, however, the colored powdering agent particles have to be dried in a separate step to prevent them from agglomerating.

Parallel to the production of the colored powdering agent, uncolored detergent particles are produced. Finally, the colored powdering agents are transferred from the spray drying tower to a separate unit after step (B) of the process. In this separate unit, the uncolored detergent particles are powdered with the separately produced colored particles of powdering agent. Accordingly, powdering with the colored particles of powdering agent is carried out separately from their production.

Colored particles suitable for incorporation in a detergent in accordance with the present invention are those which, besides the dye, contain at least one other component which contributes towards the washing or cleaning performance of the detergent. The particles produced by the process according to the invention may be used as constituents of heavy-duty detergents or as heavy-duty detergents themselves, the dyes either being very quickly destroyed by oxidation in the wash liquor so that they do not give off any dye to the laundry, even at high washing temperatures, or being used to color laundry through the release of dye during the washing process, depending entirely on the choice of the dye. It is also possible to use dye mixtures which, besides dyes capable of oxidative destruction, contain blue dyes suitable for detergents which, as blueing agents, compensate for the yellowing of washed laundry.

Any dyes capable of oxidative destruction in the washing and mixtures thereof with suitable blue dyes, so-called blueing agents, are preferred. It has proved to be of advantage to use dyes which are soluble in water or in liquid organic substances at room temperature. Suitable dyes are, for example, anionic dyes, for example anionic nitroso dyes. One possible dye is, for example, naphthol green (Colour Index (CI) Part 1: Acid Green 1, Part 2: 10020), which is commercially obtainable, for example, as Basacid® Grün 970 from BASF, Ludwigshafen, and mixtures thereof with suitable blue dyes. Other suitable dyes are Pigmosol® Blau 6900 (CI 74160), Pigmosol® Grün 8730 (CI 74260), Basonyl® Rot 545 FL (CI 45170), Sandolan® Rhodamin EB400 (CI 45100), Basacid® Gelb 094 (CI 47005), Sicovit® Patentblau 85 E 131 (CI 42051), Acid Blue 183 (CAS 12217-22-0, CI Acidblue 183), Pigment Blue 15 (CI 74160), Supranol® Blau GLW (CAS 12219-32-8, CI Acidblue 221)), Nylosan® Gelb N-7GL SGR (CAS 61914-57-1, CI Acidyellow 218) and/or Sandolan® Blau (CI Acid Blue 182, CAS 12219-26-0).

In choosing the dye, it is important to ensure that it does not have an excessive affinity for the textile surfaces and, more particularly, for synthetic fibers. Another factor to be taken into account in the choice of suitable dyes is that dyes differ in their stability to oxidation. In general, water-insoluble dyes are more stable to oxidation than water-soluble dyes. The concentration of the dye in the detergents varies according to its solubility and, hence, its sensitivity to oxidation. In the case of readily water-soluble dyes, for example the Basacid® Grün mentioned above or the Sandolan® Blau also mentioned above, dye concentrations of $10^{-2}$ to $10^{-3}$% by weight are typically selected. By contrast, in the case of the pigment dyes particularly preferred for their brilliance, but less readily soluble in water, for example the above-mentioned Pigmosol® dyes (Pigmosol® TAED), suitable dye concentrations in detergents are typically $10^{-3}$ to $10^{-4}$% by weight.

To prevent destruction of the dye in storage, it is of advantage if the dye is stable at temperatures of up to 40° C.

The stability of the detergents containing the particles produced by the process according to the invention can be increased by a low water content. In the presence of water, the dyes—in a particularly preferred embodiment—react to a certain extent with atmospheric oxygen or with oxygen present in the water. In this case, there is no need for bleaching agents to be present, which is particularly advantageous for light-duty detergents.

The dyes used for producing the colored particles should be sufficiently resistant to heat and alkalis and should not color the laundry or parts of the washing machine, even after repeated washing, and at the same time should not show any substantivity towards textile fibers so as not to color the laundry.

However, if the dyes are absorbed onto the textile fibers, the color absorbed onto the textiles should be destroyed by reaction with the oxidizing agents so that coloring of the textiles, particularly over several washing cycles, is avoided. In one preferred embodiment of the present invention, therefore, the dye is completely or partly destroyed by oxidation in the washing process.

The oxidative reaction of the dye with an oxidizing agent should be a fast reaction so that the dye decomposes on contact with the oxidizing agent. If the particles produced by the process according to the invention come into contact with water, a colored wash liquor is generally formed to begin with, but is soon decolored by the bleaching agent which also dissolves on contact with water. The colored wash liquor is at least 50%, preferably at least 80% and more preferably at least 90% decolored at 60° C., preferably 5 to 10 minutes after dissolution in water. The degree of oxidative destruction of the dye may be determined, for example, from extinction measurements, i.e. by measuring the extinction $E_0$ of the wash liquor with a known concentration $C_0$ of dye and the extinction $E_1$ of the wash liquor after a certain time. The quantity $C_0$ of dye still present may be calculated from the extinction values thus determined using the Lambert-Beer law. The rate at which the dye oxidizes should be greater, the higher its substantivity towards the laundry.

The colored particles produced by the process according to the invention or detergents containing these particles preferably have such a low substantivity towards textiles that, after 25 washing cycles, the Ganz/Grieser color deviation value of cotton fabrics with a Ganz whiteness of more than 200 is between −1.5 and ≦2.5.

Suitable oxidizing agents are, for example, the substances typically present as bleaching agents in the detergents. These include in particular compounds which yield $H_2O_2$ in water. Of these compounds, sodium perborate tetrahydrate and sodium perborate monohydrate are particularly important. Other useful bleaching agents are, for example, sodium percarbonate, peroxypyrophosphates, citrate perhydrates and $H_2O_2$-yielding peracidic salts or peracids, such as perbenzoates, peroxyphthalates, diperazelaic acid or diperdodecanedioic acid. In order to decolor the dye completely in the time mentioned above, the oxidizing agent should be present in a sufficient quantity. If it is intended to incorporate the particles produced in accordance with the invention in a light-duty detergent intended in particular for colored fabrics which are not intended to be bleached, the dye may be used without a separately added oxidizing agent. The dye and the oxidizing agent may be present in a ratio by weight of up to about $1:10^4$ and preferably 1:100 to $8\times10^3$, the quantities of oxidizing agent being kept as small as possible to preserve the fibers of the fabrics. Accordingly, the dye and the bleaching agent for decoloring the dye are preferably present in a ratio by weight of up to 1:500.

The detergent produced by the process according to the invention may be a heavy-duty detergent, a color detergent or a light-duty detergent. If the detergent is a light-duty detergent, it should not contain any bleaching agent other than the bleaching agent required to oxidize the dye unless the dye is oxidized by oxygen in the presence of water.

The detergents produced by a process according to the invention in which the bleaching agents are also intended to contribute towards the washing performance, for example to the removal of bleachable soils, have a total content of bleaching agents of preferably 5 to 30% by weight and more preferably 10 to 25% by weight.

In one preferred embodiment, the process is carried out using colored particles containing bleach activator. This is because the effectiveness of the oxidizing or bleaching agent can be significantly increased by the addition of so-called bleach activators. Accordingly, detergent particles containing bleach activators are colored in the practical application of the production process according to the invention and, finally, are incorporated in bleach-containing detergents in order to obtain an improved bleaching effect where washing is carried out at temperatures of 60° C. or lower. Examples of bleach activators are N-acyl or O-acyl compounds which form organic peracids with $H_2O_2$, preferably N,N'-tetraacylated diamines, alkanoyloxybenzenesulfonates, such as iso- and n-nonanoyloxybenzene-sulfonates, carboxylic anhydrides and esters of polyols, such as glucose pentaacetate. Other known bleach activators are the acetylated mixtures of sorbitol and mannitol which are described, for example, in European patent application EP-A-0 525 239. The content of bleach activators in the bleach-containing detergents is in the usual range, preferably between 1 and 10% by weight and more preferably between 2 and 8% by weight. Particularly preferred bleach activators are N,N,N',N'-tetraacetyl ethylenediamine (TAED), 1,5-diacetyl-2,4-dioxohexahydro-1,3,5-triazine (DADHT) and acetylated sorbitol/mannitol mixtures (SORMAN®).

In one preferred embodiment, the colored spray-dried powdering agents and the detergent particles are thoroughly mixed. Mixing units suitable for this purpose are known to the expert. In this way, the powdering agents adhere to the surface of the detergent particles and provide the detergent with the required color characteristics.

The detergent particles to which the colored powdering agents are added may be granulated detergent particles, spray-dried detergent particles or solid detergent particles. Before the colored powdering agent is applied, the detergent particles may be produced in known manner, for example by spray drying, by granulation or by extrusion. The particles may be produced in particular by granulation and simultaneous drying, advantageously by the fluidized-bed process described in International patent application WO 93/04162.

However, the uncolored surfactant-containing detergent particles may also be produced by extrusion as described, for example, in European patent applications EP-A-0 339 996, EP-A-0 420 317 or International patent application WO-A-93/23523 or European patent EP-B-0 486 592.

Suitable powdering agents which are colored with dye by the process according to the invention are inorganic builders. Besides the traditional phosphates, alumosilicates of the zeolite type are particularly suitable for this purpose. In one particularly preferred embodiment, the finely crystalline, synthetic zeolite containing bound water used is zeolite NaA, above all Wessalith® P, in detergent quality. However, zeolite X and zeolite P and mixtures of A and X or A and X and/or P are also suitable.

A commercially obtainable inorganic builder which may be used with advantage for the purposes of the present invention is the co-crystallizate of zeolite X and zeolite A (ca. 80% by weight zeolite X) marketed by CONDEA Augusta S.p.A. under the name of VEGOBOND AX® which may be described by the following formula:

$$n\mathrm{Na_2O}.(1\text{-}n)\mathrm{K_2O}.\mathrm{Al_2O_3}.(2\text{–}2.5)\mathrm{SiO_2}.(3.5\text{–}5.5)\mathrm{H_2O}$$

Suitable substitutes or partial substitutes for phosphates and zeolites are crystalline layer-form sodium silicates with the general formula $NaMSi_xO_{2x+1}.y\ H_2O$, where M is sodium or hydrogen, x is a number of 1.9 to 4 and y is a number of 0 to 20, preferred values for x being 2, 3 or 4. Crystalline layer silicates such as these are described, for example, in European patent application EP-A-0 164 514. Preferred crystalline layer silicates are those in which M is sodium and x assumes the value 2 or 3. Both β- and δ-sodium disilicates $Na_2Si_2O_5.y\ H_2O$ are particularly preferred powdering agents.

In one preferred embodiment of the process according to the invention, a ratio by weight of detergent particles to colored powdering agent of 95:5 to 99.5:0.5 and, more particularly, a ratio by weight of 97:3 to 99:1 is adjusted during application of the colored and spray-dried powdering agent to the detergent particles. With ratios by weight such as these, the resulting detergent creates a satisfactory color impression.

The detergent particles used in the process according to the invention may advantageously contain the components typically used in detergents such as, for example, anionic, nonionic and/or amphoteric surfactants and/or builders.

The anionic surfactants used are, for example, those of the sulfonate and sulfate type. Suitable surfactants of the sulfonate type are preferably $C_{9\text{-}13}$ alkyl benzenesulfonates, olefin sulfonates, i.e. mixtures of alkene and hydroxyalkane sulfonates, and the disulfonates obtained, for example, from $C_{12\text{-}18}$ monoolefins with an internal or terminal double bond by sulfonation with gaseous sulfur trioxide and subsequent alkaline or acidic hydrolysis of the sulfonation products. Other suitable surfactants of the sulfonate type are the alkane sulfonates obtained from $C_{12\text{-}18}$ alkanes, for example by sulfochlorination and subsequent hydrolysis or neutralization. The esters of α-sulfofatty acids (ester sulfonates), for example the α-sulfonated methyl esters of hydrogenated coconut oil, palm kernel oil or tallow fatty acids, are also suitable.

Suitable surfactants of the sulfate type are the sulfuric acid monoesters of primary alcohols of natural and synthetic origin. Preferred alk(en)yl sulfates are the alkali metal salts and, in particular, the sodium salts of the sulfuric acid semiesters of $C_{12\text{-}18}$ fatty alcohols, for example cocofatty alcohol, tallow fatty alcohol, lauryl, myristyl, cetyl or stearyl alcohol, or $C_{10\text{-}20}$ oxoalcohols and the corresponding semiesters of secondary alcohols with the same chain length. Other preferred alk(en)yl sulfates are those with the chain length mentioned which contain a synthetic, linear alkyl chain based on a petrochemical and which are similar in their degradation behavior to the corresponding compounds based on oleochemical raw materials.

$C_{12\text{-}16}$ alkyl sulfates and $C_{12\text{-}15}$ alkyl sulfates and also $C_{14\text{-}15}$ alkyl sulfates are particularly preferred from the washing performance point of view.

The sulfuric acid monoesters of linear or branched $C_{7\text{-}21}$ alcohols ethoxylated with 1 to 6 moles of ethylene oxide, such as 2-methyl-branched $C_{9\text{-}11}$ alcohols containing on average 3.5 moles of ethylene oxide (EO) or $C_{12\text{-}18}$ fatty alcohols containing 1 to 4 EO, are also suitable. In view of their high foaming capacity, they are only used in relatively small quantities, for example in quantities of 1 to 5% by weight, in detergents.

Other suitable anionic surfactants are sulfonated fatty acid glycerol esters, i.e. the monoesters, diesters and triesters and mixtures thereof which are obtained where production is carried out by esterification of a monoglycerol with 1 to 3 moles of fatty acid or in the transesterification of triglycerides with 0.3 to 2 moles of glycerol. Preferred sulfonated fatty acid glycerol esters are the sulfonation products of saturated fatty acids containing 6 to 22 carbon atoms, for example caproic acid, caprylic acid, capric acid, myristic acid, lauric acid, palmitic acid, stearic acid or behenic acid.

Other suitable anionic surfactants are the salts of alkyl sulfosuccinic acid which are also known as sulfosuccinates or as sulfosuccinic acid esters and which represent monoesters and/or diesters of sulfosuccinic acid with alcohols, preferably fatty alcohols and, more particularly, ethoxylated fatty alcohols. Preferred sulfosuccinates contain $C_{8\text{-}18}$ fatty alcohol molecules or mixtures thereof. Particularly preferred sulfosuccinates contain a fatty alcohol molecule derived from ethoxylated fatty alcohols which, considered in isolation, represent nonionic surfactants (for a description, see below). Of these sulfosuccinates, those of which the fatty alcohol molecules are derived from narrow-range ethoxylated fatty alcohols are particularly preferred. Alk(en)yl succinic acid preferably containing 8 to 18 carbon atoms in the alk(en)yl chain or salts thereof may also be used.

Other suitable anionic surfactants are, in particular, soaps. Suitable soaps are saturated fatty acid soaps, such as the salts of lauric acid, myristic acid, palmitic acid, stearic acid, hydrogenated erucic acid and behenic acid, and soap mixtures derived in particular from natural fatty acids, for example coconut oil, palm kernel oil or tallow fatty acids.

The synthetic anionic surfactants and soaps may be present in the form of their sodium, potassium or ammonium salts and as soluble salts of organic bases, such as mono-, di- or triethanolamine. The anionic surfactants are preferably present in the form of their sodium or potassium salts and, more preferably, in the form of their sodium salts.

Preferred nonionic surfactants are alkoxylated, advantageously ethoxylated, more particularly primary alcohols preferably containing 8 to 18 carbon atoms and an average of 1 to 12 moles of ethylene oxide (EO) per mole of alcohol, in which the alcohol radical may be linear or, preferably, 2-methyl-branched or may contain linear and methyl-branched radicals in the form of the mixtures typically present in oxoalcohol radicals. However, alcohol ethoxylates containing linear radicals of alcohols of native origin with 12 to 18 carbon atoms, for example coconut oil fatty alcohol, palm oil fatty alcohol, tallow fatty alcohol or oleyl alcohol, and an average of 2 to 8 EO per mole of alcohol are particularly preferred. Preferred ethoxylated alcohols include, for example, $C_{12\text{-}14}$ alcohols containing 3 EO or 4 EO, $C_{9\text{-}11}$ alcohols containing 7 EO, $C_{13\text{-}15}$ alcohols containing 3 EO, 5 EO, 7 EO or 8 EO, $C_{12\text{-}18}$ alcohols containing 3 EO, 5 EO or 7 EO and mixtures thereof, such as mixtures of $C_{12\text{-}14}$ alcohol containing 3 EO and $C_{12\text{-}18}$ alcohol containing 5 EO. The degrees of ethoxylation mentioned are statistical mean values which, for a special product, may be either a whole number or a broken number. Preferred alcohol ethoxylates have a narrow homolog distribution (narrow range ethoxylates, NRE). In addition to these nonionic surfactants, fatty alcohols containing more than 12 EO may also be used. Examples of such fatty alcohols are tallow fatty alcohol containing 14 EO, 25 EO, 30 EO or 40 EO.

Other suitable nonionic surfactants include alkyl glycosides with the general formula $RO(G)_x$ where R is a primary, linear or methyl-branched, more particularly 2-methyl-branched, aliphatic radical containing 8 to 22 and preferably 12 to 18 carbon atoms, G is a glycose unit containing 5 or 6 carbon atoms, preferably glucose, and the degree of oligomerization x—which indicates the distribution of monoglycosides and oligoglycosides—is a number of 1 to 10 and preferably a number of 1.2 to 1.4.

Other nonionic surfactants which are used either as sole nonionic surfactant or in combination with other nonionic surfactants are alkoxylated, preferably ethoxylated or ethoxylated and propoxylated, fatty acid alkyl esters preferably containing 1 to 4 carbon atoms in the alkyl chain, more particularly the fatty acid methyl esters which are described, for example, in Japanese patent application JP 58/217598 or which are preferably produced by the process described in International patent application WO-A-90/13533.

Nonionic surfactants of the amine oxide type, for example N-cocoalkyl-N,N-dimethylamine oxide and N-tallowalkyl-N,N-dihydroxyethyl amine oxide, and the fatty acid alkanolamide type are also suitable. The quantity in which these nonionic surfactants are used is preferably no more, in particular no more than half, the quantity of ethoxylated fatty alcohols used. Other suitable surfactants are polyhydroxyfatty acid amides corresponding to formula (I):

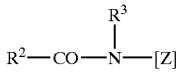

(I)

in which $R^2$—CO is an aliphatic acyl radical containing 6 to 22 carbon atoms, $R^3$ is hydrogen, an alkyl or hydroxyalkyl radical containing 1 to 4 carbon atoms and [Z] is a linear or branched polyhydroxyalkyl radical containing 3 to 10 carbon atoms and 3 to 10 hydroxyl groups. The polyhydroxyfatty acid amides are known substances which may normally be obtained by reductive amination of a reducing sugar with ammonia, an alkylamine or an alkanolamine and subsequent acylation with a fatty acid, a fatty acid alkyl ester or a fatty acid chloride.

Besides the surfactants already described in detail, the other ingredients include in partiular inorganic and organic builders, components which prevent the resoiling of fabrics (soil repellents) and redeposition inhibitors, alkaline salts, bleaching agents and bleach activators, foam inhibitors, fabric softeners, neutral salts and dyes and perfumes.

Apart from the conventional phosphates, suitable inorganic builders are in particular alumosilicates of the zeolite type. The finely crystalline synthetic zeolite containing bound water used is preferably detergent-quality zeolite NaA. However, zeolite X and zeolite P and mixtures of A and X and/or P are also suitable.

Suitable substitutes or partial substitutes for phosphates and zeolites are crystalline layer-form sodium silicates corresponding to the general formula $NaMSi_xO_{2x+1}.yH_2O$, where M is sodium or hydrogen, x is a number of 1.9 to 4 and y is a number of 0 to 20, preferred values for x being 2, 3 or 4. Crystalline layer silicates such as these are described, for example, in European patent application EP-A-0 164 514. Preferred crystalline layer silicates corresponding to the above formula are those in which M is sodium and x assumes the value 2 or 3. Both β- and δ-sodium disilicates —$Na_2Si_2O_5.yH_2O$ are particularly preferred.

Useful organic builders are, for example, polycarboxylic acids usable in the form of their sodium salts, such as citric acid, adipic acid, succinic acid, glutaric acid, tartaric acid, sugar acids, aminocarboxylic acids, nitrilotriacetic acid (NTA), providing their use is not ecologically unsafe, and mixtures thereof. Preferred salts are the salts of the polycarboxylic acids, such as citric acid, adipic acid, succinic acid, glutaric acid, tartaric acid, sugar acids and mixtures thereof.

Suitable polymeric polycarboxylates are, for example, the sodium salts of polyacrylic acid or polymethacrylic acid, for example those with a relative molecular weight of 800 to 150,000 (based on acid). Suitable copolymeric polycarboxylates are, in particular, those of acrylic acid with methacrylic acid and of acrylic acid or methacrylic acid with maleic acid. Acrylic acid/maleic acid copolymers containing 50 to 90% by weight of acrylic acid and 50 to 10% by weight of maleic acid have proved to be particularly suitable. Their relative molecular weight, based on free acids, is generally in the range from 5,000 to 200,000, preferably in the range from 10,000 to 120,000 and more preferably in the range from 50,000 to 100,000. Also particularly preferred are biodegradable terpolymers, for example those which contain salts of acrylic acid and maleic acid and vinyl alcohol or vinyl alcohol derivatives as monomers (DE-A-43 00 772) or salts of acrylic acid and 2-alkylallyl sulfonic acid and sugar derivatives as monomers (DE-C-42 21 381).

Other preferred builders are the known polyaspartic acids and salts and derivatives thereof.

Other suitable builders are polyacetals which may be obtained by reaction of dialdehydes with polyol carboxylic acids containing 5 to 7 carbon atoms and at least three hydroxyl groups, for example as described in European patent application EP-A0 280 223. Preferred polyacetals are obtained from dialdehydes, such as glyoxal, glutaraldehyde, terephthal-aldehyde and mixtures thereof and from polyol carboxylic acids, such as gluconic acid and/or glucoheptonic acid.

The inorganic and/or organic builders are used in the detergents produced in accordance with the invention in quantities of preferably about 10 to 60% by weight and more preferably 15 to 50% by weight. The detergents according to the invention may additionally contain components which have a positive effect on the removability of oil and fats from textiles by washing. This effect becomes particularly clear when a textile which has already been repeatedly washed with a detergent according to the invention containing this oil- and fat-dissolving component is soiled. Preferred oil- and fat-dissolving components include, for example, nonionic cellulose ethers, such as methyl cellulose and more particularly methyl hydroxypropyl cellulose containing 15 to 30% by weight of methoxyl groups and 1 to 15% by weight of hydroxypropoxyl groups, based on the nonionic cellulose ether, and the polymers of phthalic acid and/or terephthalic acid known from the prior art or derivatives thereof, more particularly polymers of ethylene terephthalates and/or polyethylene glycol terephthalates or anionically and/or nonionically modified derivatives thereof. They can be effective in only small quantites. Accordingly, their content is preferably 0.2 to 10% by weight and more particularly up to 5% by weight.

In addition, redeposition inhibitors are also preferably present in the detergent particles to be produced in accordance with the invention. The function of redeposition inhibitors is to keep the soil detached from the fibers suspended in the wash liquor and thus to prevent the soil from being re-absorbed by the washing. Suitable redeposition inhibitors are water-soluble, generally organic colloids, for example the water-soluble salts of polymeric carboxylic acids, glue, gelatine, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example degraded starch, aldehyde starches, etc., may also be used. Polyvinyl pyrrolidone is also suitable. However, cellulose ethers, such as carboxymethyl cellulose (sodium salt), methyl cellulose, hydroxyalkyl cellulose, and mixed ethers, such as methyl hydroxyethyl cellulose, methyl hydroxypropyl cellulose, methyl carboxymethyl cellulose and mixtures thereof, and polyvinyl pyrrolidone are also preferably used, for example in quantities of 0.1 to 5% by weight, based on the formulation as a whole.

Other suitable ingredients of the detergents are water-soluble inorganic salts, such as bicarbonates, carbonates, amorphous silicates or mixtures thereof; alkali metal carbonate and amorphous alkali metal silicate, above all sodium silicate with a molar $Na_2O:SiO_2$ ratio of 1:1 to 1:4.5 and preferably 1:2 to 1:3.5, are particularly suitable. The sodium carbonate content of the detergents is preferably up to 20% by weight and advantageously between 5 and 15% by weight. The sodium silicate content of the detergents is generally up to 10% by weight and preferably between 2 and 8% by weight.

The amorphous silicates, like some commercially obtainable compounds of carbonates and amorphous silicates, are suitable for partly or completely replacing the traditional builders, such as phosphate, zeolite and crystalline layer silicates. If such substances are used, their content may even exceed the quantities mentioned above for carbonates and amorphous silicates. Contents of up to 40% by weight or even 60% by weight are entirely within the scope of the invention.

In addition, foam inhibitors are preferably present in the detergent particles to be produced in accordance with the invention. More particularly, it is of advantage to use foam inhibitors for formulations which are used in machine washing processes. Suitable foam inhibitors are, for example, soaps of natural or synthetic origin which have a high percentage content of $C_{18-24}$ fatty acids. Suitable non-surface-active foam inhibitors are, for example, organopolysiloxanes and mixtures thereof with microfine, optionally silanized, silica or bis-stearyl ethylenediamide. Mixtures of different foam inhibitors, for example mixtures of silicones, paraffins and waxes, may also be used with advantage. The foam inhibitors, more particularly silicone- and/or paraffin-containing foam inhibitors, are preferably fixed to a granular water-soluble or water-dispersible support. Mixtures of paraffins and bis-stearyl ethylenediamides are particularly preferred.

The neutrally reacting sodium salts of, for example, 1-hydroxyethane-1,1-diphosphonate, diethylenetriamine pentamethylene phosphonate or ethylenediamine tetramethylene phosphonate in quantities of 0.1 to 1.5% by weight are preferably used as the salts of polyphosphonic acids.

In addition, enzymes may optionally be used in the detergent particles produced in accordance with the invention. Particularly suitable enzymes are, in particular, enzymes from the class of proteases, lipases, amylases, cellulases and mixtures thereof. Enzymes obtained from bacterial strains or fungi, such as Bacillus subtilis, Bacillus licheniformis and Streptomyces griseus are particularly suitable. Proteases of the subtilisin type are preferably used, proteases obtained from Bacillus lentus being particularly preferred. Of particular interest in this regard are enzyme mixtures, for example of protease and amylase or protease and lipase or protease and cellulase or of cellulase and lipase or of protease, amylase and lipase or protease, lipase and cellulase, but especially cellulase-containing mixtures. Peroxidases or oxidases have also proved to be suitable in some cases. The enzymes may be adsorbed to supports and/or encapsulated in membrane materials to protect them against premature decomposition. The percentage content of enzymes, enzyme mixtures or enzyme granules is, for example, about 0.1 to 5% by weight and preferably 0.1 to 2% by weight.

Components which prevent the resoiling of fabrics (soil repellents) are, in particular, compounds which prevent the soil particles detached during the washing process from settling and thus avoid the formation of a so-called grey bloom without affecting enzyme activity or washing performance. Such components are generally polymeric and copolymeric compounds, such as polyesters of aliphatic and/or aromatic dicarboxylic acids and glycols and/or polyglycols.

The particles produced in accordance with the invention may contain derivatives of diaminostilbene disulfonic acid or alkali metal salts thereof as optical brighteners. Suitable optical brighteners are, for example, salts of 4,4'-bis-(2-anilino-4-morpholino-1,3,5-triazinyl-6-amino)-stilbene-2,2'-di-sulfonic acid or compounds of similar structure which contain a diethanolamino group, a methylamino group and anilino group or a 2-methoxyethylamino group instead of the morpholino group. Brighteners of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)4'-(2-sulfostyryl)-diphenyl, may also be present. Mixtures of the brighteners mentioned may also be used.

The invention is illustrated by the following Examples.

EXAMPLES

Example 1

Wessalith® P as zeolite A in combination with 1, 2 or 3% Supranol® Blau GLW for the production of a blue powdering agent.

Example 2

Wessalith® P in combination with 0.8% of Supranol® Blau and 0.8% of Nylosan® Gelb N7-GL for the production of a green powdering agent.

Example 3

Wessalith® P in combination with 1.6% of Supranol® Blau and 1.6% of Nylosan® Gelb N7-GL for the production of a green powdering agent.

Example 4

Wessalith® P in combination with 2.5% of Supranol® Blau and 2.5% of Nylosan® Gelb N7-GL for the production of a green powdering agent.

Example 5

For comparison, the dye used in Example 4 was made up into a powder with no other additives.

To produce the powdering agents of Examples 1 to 4, Wessalith P was spray-dried with the respective dyes in a separate spray drying tower. The colored powdering agents according to Examples 1 to 4 were then thoroughly mixed with detergent granules so that the colored powdering agents adhered to the surface of the surfactant-rich granules.

Results

During the powdering of the detergent particles with the colored powdering agents, no dye residues were left in the installation in which the powdering process is carried out.

By comparison, cleaning of the spray drying tower, i.e. the removal of dye residues, in known processes where a slurry of detergent components and dyes is spray-dried has to be carried out at regular intervals. Comparison measurements with dye powders as sole component during the powdering of uncolored detergent particles also fail to produce the favorable optical impression of detergents produced by the process according to the invention.

The colored powdering agents mentioned in Examples 1 to 4 were tested as ingredients of colored detergents. White cotton fabrics were washed 25 times at 90° C. using 150 g of the detergent per wash cycle. The discoloration of the fabrics was determined visually and by measurement to DIN 5033 and the guideline RAL-RG 992 "Gütesicherung sachgemäße Wäschepflege".

Detergents according to the invention produced with the colored powdering agent of Example 1 did not produce any blue discoloration of the fabrics by comparison with dye-free powder. Detergents according to the invention colored with the powdering agents of Examples 2 to 4 produced equally little green discoloration of the fabrics by comparison with dye-free powder.

In particular, the dye concentrations are so high that complete oxidative destruction of the dyes is no longer guaranteed.

By contrast, detergents of particles aftertreated with the dye powder of Example 5 showed considerable dye residues (green) on the fabrics, despite the same treatment, in consequence of the high dye concentration.

What is claimed is:

1. A process for the production of colored detergent particles, the process comprising the steps of:

(A) forming a slurry consisting of at least one inorganic powdering agent, at least one dye, and optionally a bleach activator;

(B) spray drying the slurry to form colored particles of powdering agent; and (C) applying the colored particles of powdering agent to detergent particles that comprise at least one surfactant, builder, and bleaching agent, wherein steps (B) and (C) are carried out separately, to form colored detergent particles.

2. The process of claim 1, wherein the colored detergent particles comprise a bleaching agent and the weight ratio of the at least one dye in the colored detergent particles to the bleaching agent is not more than 1:500.

3. The process of claim 1, wherein the bleach activator is present in the slurry.

4. The process of claim 1, wherein the colored powdering agent and the detergent particles are thoroughly mixed together during step (C).

5. The process of claim 1, wherein the detergent particles of step (C) are formed by granulation.

6. The process of claim 1, wherein the detergent particles of step (C) are formed by spray drying.

7. The process of claim 1, wherein the inorganic powdering agent is zeolite.

8. The process of claim 7, wherein the zeolite is zeolite NaA.

9. The process of claim 1, wherein the weight ratio of the detergent particles to the colored particles of powdering agent is from 95:5 to 99.5:0.5.

10. The process of claim 1, wherein the weight ratio of the detergent particles to the colored particles of powdering agent is from 97:3 to 99:1.

* * * * *